US008025121B2

(12) United States Patent
Callahan et al.

(10) Patent No.: US 8,025,121 B2
(45) Date of Patent: Sep. 27, 2011

(54) TUBE STRUCTURE FOR EXHAUST COMPONENT

(75) Inventors: Joseph E. Callahan, Greenwood, IN (US); David J. Leehaug, Columbus, IN (US)

(73) Assignee: Emcon Technologies LLC

( * ) Notice: Subject to any disclaimer, the term of this patent is extended or adjusted under 35 U.S.C. 154(b) by 98 days.

(21) Appl. No.: 12/367,686

(22) Filed: Feb. 9, 2009

(65) Prior Publication Data

US 2010/0199651 A1 Aug. 12, 2010

(51) Int. Cl.
*F01K 5/00* (2006.01)

(52) U.S. Cl. ..... 181/212; 181/251; 29/890.08

(58) Field of Classification Search ..... 181/212, 181/251; 29/890.08
See application file for complete search history.

(56) References Cited

U.S. PATENT DOCUMENTS 2,561,557 A * 7/1951 Biddlecombe ..... 181/251
2,624,418 A * 1/1953 Bourne ..... 181/251
3,921,754 A * 11/1975 Hess ..... 181/212
4,570,747 A * 2/1986 Ortyl ..... 181/243
4,643,272 A 2/1987 Gafrig
4,930,597 A 6/1990 Udell
5,187,334 A 2/1993 Abbott et al.
5,229,557 A * 7/1993 Allman et al. ..... 181/282
5,477,015 A * 12/1995 Preslicka et al. ..... 181/282
7,770,690 B2 * 8/2010 Schorn et al. ..... 181/228
7,810,610 B2 * 10/2010 Nishimura et al. ..... 181/251
2007/0220872 A1 * 9/2007 Weimert et al. ..... 60/299

FOREIGN PATENT DOCUMENTS

JP 03006015 U 1/1991

OTHER PUBLICATIONS

Korean Search Report dated Jul. 13, 2010.

* cited by examiner

*Primary Examiner* — Forrest M Phillips
(74) *Attorney, Agent, or Firm* — Pamela A. Kachur

(57) ABSTRACT

A vehicle exhaust component includes an outer shell defining an internal cavity, at least one baffle located within the internal cavity, and at least one tube supported by the baffle. The baffle is fixed to the outer shell and includes at least one opening. The tube has first and second tube ends with one of the first and second tube ends being supported within the opening in the baffle. At least one slot is formed within the one of the first and second tube ends at the at least one opening. The slot facilitates noise reduction during cool down of the vehicle exhaust component.

17 Claims, 1 Drawing Sheet

TUBE STRUCTURE FOR EXHAUST COMPONENT

TECHNICAL FIELD

The subject invention relates to a tube structure used in a vehicle exhaust system, and more particularly relates to a tube structure that is configured to reduce undesirable noise generated during cooling of the exhaust system.

BACKGROUND OF THE INVENTION

Exhaust systems are widely known and used with combustion engines. Typically, an exhaust system includes exhaust tubes that convey hot exhaust gases from the engine to other exhaust system components, such as mufflers, resonators, etc. Mufflers and resonators include acoustic chambers that cancel out sound waves carried by the exhaust gases.

One common problem with exhaust system components, such as a muffler for example, is metallic noise that emanates from the muffler during cool down. The metallic noise is often referred to as a pinging or ticking sound. The muffler includes tubes that are supported by internal muffler structures. When the exhaust system heats up during vehicle operation, the tubes experience thermal expansion, which causes mating surfaces between the tubes and associated internal structures to fit more tightly against each other. When the vehicle is turned off, the exhaust system components cool down and the metallic noise is generated when the mating surfaces release. This release of strain energy caused by the differential thermal expansion of the tubes relative to the internal muffler structures is also referred to as a "stick and release" noise. The components become "stuck" together during thermal expansion, and then when the components are "released" from each other during cool down, the metallic noise is generated.

Therefore, there is a need to provide an exhaust component configuration that reduces noise generated during cool down. This invention addresses those needs while avoiding the shortcomings and drawbacks of the prior art.

SUMMARY OF THE INVENTION

A vehicle exhaust component includes a baffle that supports at least one tube. The baffle includes at least one opening that receives the tube. The tube includes at least one slot at the opening. The slot facilitates noise reducing during cool down.

In one example, the at least one baffle is located within an internal cavity of the outer shell. The baffle is fixed to the outer shell. The tube has first and second tube ends wherein one of the first and second tube ends is supported within the at least one opening formed within the baffle. The at least one slot is formed to extend from an endmost edge of the tube in an axial direction toward the associated opening.

In one example, the tube defines a central axis and the at least one slot comprises a plurality of slots. The slots are circumferentially spaced apart from each other about the central axis.

In one example, the at least one baffle comprises a plurality of baffles and the at least one tube comprises a plurality of tubes. Each tube is supported by at least one baffle of the plurality of baffles. The baffles include openings that receive the tubes. One or more of the tubes includes at least one slot at one of the openings.

These and other features of the present invention can be best understood from the following specification and drawings, the following of which is a brief description.

DETAILED DESCRIPTION OF THE PREFERRED EMBODIMENT

Figure 1:
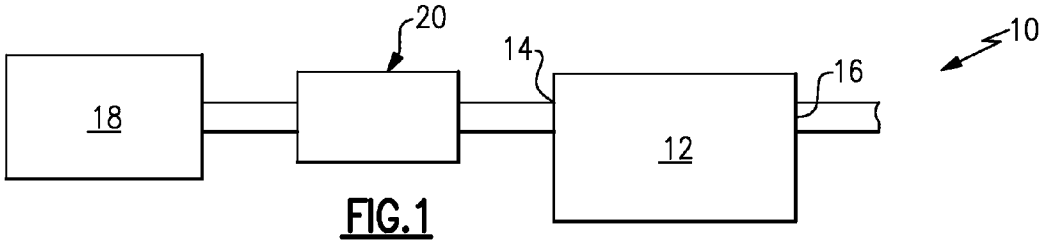
FIG. 1 shows a schematic view of an exhaust system.

As shown in FIG. 1, an exhaust system 10 includes an exhaust component 12 having an exhaust gas inlet 14 and an exhaust gas outlet 16. Exhaust gases generated by an engine 18 are communicated through the exhaust component 12 from the exhaust gas inlet 14 to the exhaust gas outlet 16. One or more exhaust components, generally referred to at 20 can be positioned between the exhaust component 12 and the engine 18. Further, additional exhaust components (not shown) may be located downstream of the exhaust component 12.

Figure 2A:
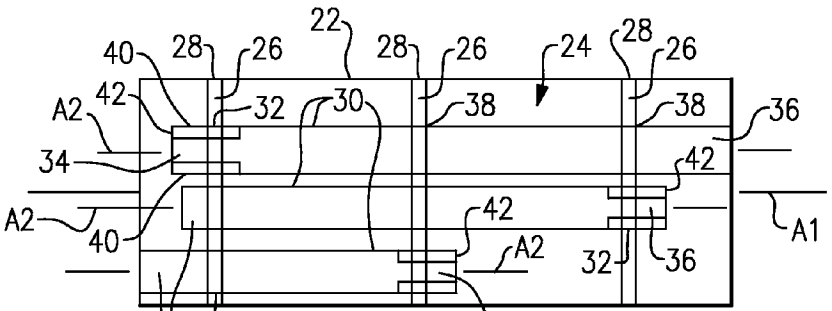
FIG. 2A shows one schematic side view of an exhaust component from the exhaust system of FIG. 1.
Figure 2B:
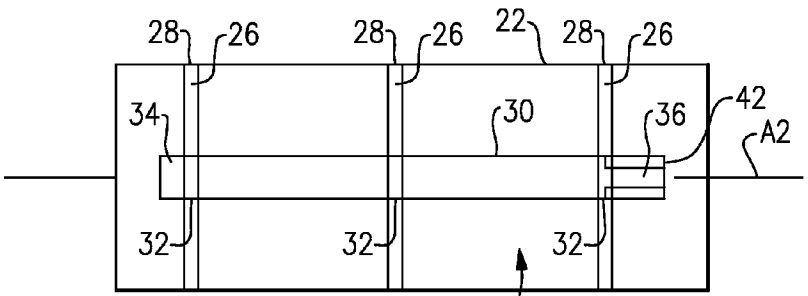
FIG. 2B shows an opposite schematic side view of the exhaust component from FIG. 2A.

In one example, the exhaust component 12 comprises a muffler. As shown in FIGS. 2A-2B, the exhaust component 12 includes an outer shell 22 defining an inner cavity 24. A central axis Al extends along a length of the outer shell 22. A plurality of baffles 26 are positioned within the internal cavity 24 and are fixed to the outer shell 22. The baffles 26 are generally flat plate structures that are secured to the outer shell 22 at corresponding outer edges 28. In one example, the baffles 26 are welded to an inner surface of the outer shell 22.

A plurality of pipes or tubes 30 are supported by the baffles 26. In the example shown, the tubes 30 comprise muffler or resonator tubes. Each tube 30 is supported by one or more baffles 26. The baffles 26 include openings 32 through which the tubes 30 extend. Each tube 30 has a first tube end 34 and an opposing second tube end 36. Further, each tube defines a central axis A2 that extends along a length of the tube.

At least one of the tubes 30 includes at least one slot 40 that extends in an axial direction that is generally parallel to the central axis A2. The slot 40 is aligned at an interface between one of the openings 32 and the associated tube 30. The slot 40 reduces a sticking force between the baffle 26 and tube 30 during thermal expansion such that metallic pinging noises are greatly reduced, or even eliminated, during cool down of the exhaust component 12.

In the example shown, there are at least two slots 40 at the opening 32 that are circumferentially spaced apart from each other about the central axis A2. In this example, the slots 40 are generally spaced one hundred and eighty degrees apart from each other. The tube could also include even more slots 40 as needed to further reduce noise.

Each slot 40 extends from an endmost end 42 of the pipe 30 toward the associated opening 32. The slot 40 extends such that at least a portion of the slot 40 overlaps with the opening 32; however, the slot 40 can extend entirely through the associated opening 32 as shown.

Figure 4:
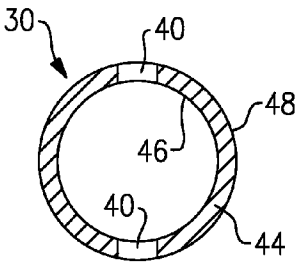
FIG. 4 shows a transverse cross-section view of a tube.
Figure 3:
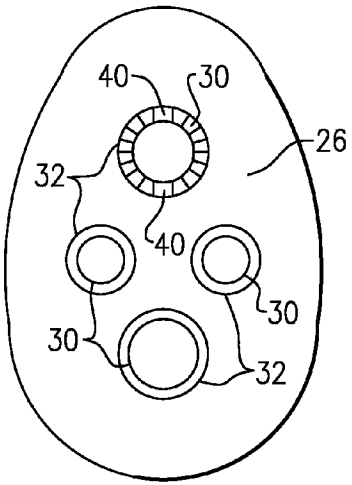
FIG. 3 is an end view of one baffle from the exhaust component from FIGS. 2A-2B.
Figure 5:
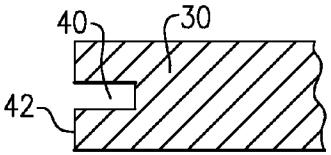
FIG. 5 shows a top section view of the tube of FIG. 4.

As shown in FIGS. 3-5, each slot 40 extends through a wall thickness 44 defined by the tube 30. Thus, the slot 40 extends radially through the tube 30 from an inner tube surface 46 to an outer tube surface 48.

In the example shown in FIG. 2A, the uppermost tube 30 has slots 40 formed within the first tube end 34. This tube 30 extends through openings 32 in each of the other baffles 26. At the first tube end 34 the tube 30 is received within the associated opening 32 in a loose fit such that the tube 30 is axially movable relative to the baffle 26. This loose fit accommodates thermal expansion as the exhaust system 10 heats up during vehicle operation, while the slot 40 operates to reduce noise when the exhaust component 12 cools down.

In this example, the remaining interfaces between this tube 30 and the other baffles 26 comprise mechanically locked interfaces 38. The mechanical lock interface comprises a deformation that occurs between the baffle 26 and the tube 30. The mechanical lock could also comprise a weld or a press-fit, for example. The mechanical lock prevents axial movement between the tube and the baffle at these locations. Optionally, methods other than mechanically locking the baffles 26 to the tubes 30 could also be used.

In one example, each tube 30 can include at least one slot 40 associated with at least one of the baffles 26, or some of the tubes may not require a slot. However, at least one tube in the plurality of tubes includes a slot. If additional noise reduction is necessary, additional slots could be formed at one end of the tube, slots could be formed at both ends of the tubes, and/or other tubes can be modified to also include slots.

It should be understood that while the above description refers generally to a muffler, the subject slotted pipe could be used in any type of exhaust component where noise generation is an issue.

The slotted pipe allows for a looser fit at the baffle interface, which results in a lower strain at this interface during thermal expansion. Having a lower strain prevents a sudden release between two abutting thermally expanded surfaces, which in turn reduces noise.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A vehicle exhaust component comprising:

An outer shell defining an internal cavity;

A plurality of baffles located within said internal cavity and fixed to said outer shell, said plurality of baffles including at least a first baffle with a first opening and a second baffle with a second opening;

At least one tube having first and second tube ends, said at least one tube being supported by said first and said second baffles; and At least one slot formed within said first tube end at said first opening and wherein said at least one tube is received within said first opening in a loose-fit and wherein said tube is mechanically locked within said second opening.

2. The vehicle exhaust component according to claim 1 wherein said at least one slot extends in an axial direction from an endmost edge of said first end to said first opening such that said at least one slot and said first opening have at least a partial overlapping relationship.

3. The vehicle exhaust component according to claim 1 wherein said at least one tube defines a central axis extending along a length of said at least one tube, and wherein said at least one slot comprises a plurality of slots circumferentially spaced apart from each other about said central axis.

4. The vehicle exhaust component according to claim 3 wherein each slot extends to an endmost edge of said first tube end.

5. The vehicle exhaust component according to claim 1 wherein said at least one tube defines a wall thickness and wherein said at least one slot extends radially through said wall thickness.

6. The vehicle exhaust component according to claim 1 wherein said first tube end is received within said first opening such that said first tube end and said first baffle are axially moveable relative to each other while said second baffle remains mechanically locked to said tube.

7. The vehicle exhaust component according to claim 1 wherein said tube is mechanically locked within said second opening at a mechanical lock interface that comprises a plastically deformed interface between said at least one tube and said baffle.

8. The vehicle exhaust component according to claim 1 wherein a connection interface at said first opening comprises the only loose fit connection and wherein all other connection interfaces at openings for said at least one tube include a mechanical lock interface.

9. The vehicle exhaust component according to claim 1 wherein said at least one tube comprises a plurality of tubes with each tube being supported by at least one of said plurality of baffles, and wherein at least one of the plurality of tubes includes said at least one slot.

10. The vehicle exhaust component to claim 1 wherein at least one tube defines a central axis extending along a length of said tube, and wherein said at least one slot comprises at least a pair of slots circumferentially spaced apart from each other about said central axis.

11. The vehicle exhaust component according to claim 10 wherein each slot extends from an endmost edge of said at least one tube in an axial direction that is generally parallel to said central axis.

12. The vehicle exhaust component according to claim 1 wherein said outer shell comprises a muffler outer shell that includes an exhaust gas inlet and an exhaust gas outlet.

13. A vehicle exhaust component comprising:

an outer shell defining an internal cavity;

an inlet tube directing exhaust gas into said internal cavity;

an outlet tube directing exhaust gas out of said internal cavity;

at least one baffle located within said internal cavity and fixed to said outer shell, said at least one baffle having at least one opening;

at least one internal resonator tube having first and second tube ends positioned within said internal cavity and enclosed by said outer shell, said at least one internal resonator tube being supported by said at least one baffle within said at least one opening; and at least one slot formed within one of said first and second tube ends, said at least one slot being located at said at least one opening.

14. The vehicle exhaust component according to claim 13 wherein said at least one baffle comprises a plurality of baffles located within said internal cavity and fixed to said outer shell, said plurality of baffles including at least a first baffle within at least one first opening and a second baffle with at least one second opening axially spaced from said first opening, and wherein said at least one internal resonator tube is supported by said first baffle within said first opening and supported by said second baffle within said second opening, and wherein said at least one slot is located at one of said first and second openings, and wherein said internal resonator tube is received within said one of said first and said second openings in a loose-fit and wherein said internal resonator tube is mechanically locked within the other of said first and said second openings.

15. The vehicle exhaust component according to claim 14 wherein the slot extends entirely through said one of said first and said second openings.

16. The vehicle exhaust component according to claim 14 wherein said loose-fit comprises the only loose-fit connection interface for said at least one tube with all other connection interfaces to said at least one tube comprising mechanical lock interfaces.

17. The vehicle exhaust component according to claim 13 wherein said at least one internal resonator tube is independent of said inlet and outlet pipes.

* * * * *